US006256956B1

(12) United States Patent
Davis

(10) Patent No.: US 6,256,956 B1
(45) Date of Patent: Jul. 10, 2001

(54) MOISTURE AND AIR RESISTANT WRAP FOR WINDOWS, DOORS AND SLIDERS AND METHOD OF USING SAME

(76) Inventor: Lawrence R. Davis, HC 69, Box 610 Stage Rd., South Pomfret, VT (US) 05067

( * ) Notice: Subject to any disclaimer, the term of this patent is extended or adjusted under 35 U.S.C. 154(b) by 0 days.

(21) Appl. No.: 09/105,508

(22) Filed: Jun. 26, 1998

Related U.S. Application Data

(60) Provisional application No. 60/051,174, filed on Jun. 27, 1997.

(51) Int. Cl.[7] ..... E04B 1/682

(52) U.S. Cl. ..... 52/408; 52/406.1; 52/406.2; 52/412; 52/741.4; 277/645; 428/192

(58) Field of Search ..... 52/62, 406.1, 408, 52/406.2, 412, 741.4, 173.2; 428/192, 193; 277/645

(56) References Cited

U.S. PATENT DOCUMENTS

| | | | | |
|---|---|---|---|---|
| 2,144,082 | * | 1/1939 | Randall | 277/645 X |
| 4,485,600 | | 12/1984 | Olson . | |
| 5,091,235 | | 2/1992 | Vergnano . | |
| 5,137,283 | * | 8/1992 | Giarrusso et al. | 277/645 X |
| 5,218,793 | | 6/1993 | Ball . | |
| 5,243,787 | * | 9/1993 | Mott et al. | 52/741.4 X |
| 5,442,825 | * | 8/1995 | Hahn et al. | 52/173.2 X |

* cited by examiner

*Primary Examiner*—Christopher T. Kent
(74) *Attorney, Agent, or Firm*—Mirick, O'Connell, DeMallie & Lougee, LLP

(57) ABSTRACT

A moisture and air tight barrier for windows, doors and sliders having improved installation and sealing characteristics, comprising a moisture and air tight wrap comprising a capsule portion and flange portion; and insulating material encapsulated in the capsule portion.

13 Claims, 11 Drawing Sheets

MOISTURE AND AIR RESISTANT WRAP FOR WINDOWS, DOORS AND SLIDERS AND METHOD OF USING SAME

CROSS-REFERENCE

This application claims priority of Provisional Application serial number 60/051,174, filed on Jun. 27, 1997.

FIELD OF THE INVENTION

This invention relates to a sealing and insulating wrap for windows, doors and sliders and more specifically to a wrap which is moisture and air tight and easily and consistently installed.

BACKGROUND OF THE INVENTION

Windows, doors and sliders are generally insulated by stuffing fiberglass insulation, cut to size, between the jamb of a window or door and the frame in which they are to be installed. However, the fiberglass alone does not provide protection against moisture from seeping into the window or door frame making the wood susceptible to wood rot. Sealing to date is accomplished imperfectly by caulking the frame after the window or door is installed. This caulking material itself is subject to deterioration and does not provide a moisture tight barrier. Water leakage, due to improper sealing is the primary cause of wood rot.

Fiberglass and methods for installing fiberglass is also unwieldy, imprecise and unpredictable. For example, first the window or door unit is installed, then the unit is shimmed and then the insulation material is packed around the unit between the jambs and the building frame. As a consequence, because there are currently no standards for installing such products, the quality of the finished installation varies from one installer to another. Once a building is completed and the inside finish work is completed there is not a way for the owner or inspector to determine the quality of installation or insulation.

Although wraps for foundation sills are known, as described in U.S. Pat. No. 5,091,235 to Vergnano, similar to the current materials and methods for sealing and insulating windows and doors, these wraps are not moisture tight and will not over time protect the insulating materials from moisture and thereby render the wood susceptible to wood rot.

SUMMARY OF THE INVENTION

It is therefore a primary object of this invention to provide a moisture and air tight wrap for windows. doors and sliders.

It is a further object of this invention to provide a wrap for windows, doors and sliders with improved vapor barrier characteristics.

It is a further object of this invention to provide a wrap for windows, doors and sliders that is easily and quickly installed.

It is a further object of this invention to provide a wrap for windows, doors and sliders that facilitates consistent, high quality installation.

It is a further object of this invention to provide a wrap for windows, doors and sliders that facilitates shimming.

It is a further object of this invention to provide a wrap for windows, doors and sliders which provides added value for the contractor and manufacturer.

It is a further object of this invention to provide a wrap for windows, doors and sliders which provides longer term value to the building owner.

A preferred embodiment of the moisture and air tight wrap of this invention for windows, doors and sliders, having improved installation and sealing characteristics, comprises: a moisture and air tight barrier comprising a capsule portion and a flange portion; and insulating material substantially encapsulated in the capsule portion. The wrap preferably comprises a moisture resistant gasket fixed to the flange portion.

The barrier comprises a sheet of plastic of which a portion is folded over on itself and sealed in place, thereby forming the capsule. In another preferred embodiment, the barrier comprises two sheets of plastic, having one or more corresponding edges, sealed together along one or more of the edges, thereby forming the capsule. The wrap may also comprise a tube into which the insulation materials are inserted.

The capsule is preferably adapted to sit between a jamb of the window or door and an opening in which the window, door or slider, respectively, is installed. The capsule may also be adapted to compress under a pressure exerted by shims without degrading the moisture or air tightness of said wrap. In turn, the gasket is preferably adapted to sit between an exterior trim of the window, door or slider and an exterior wall of an opening in which the window, door or slider, respectively, is installed.

Another preferred embodiment of the moisture and air resistant wrap of the invention for windows, doors and sliders, comprises: an insulating material; a moisture and air resistant capsule which substantially encapsulates the insulating material therein; a sealing flange, flexibly joined with the means for encapsulating; and a moisture resistant gasket fixed to the flange. The capsule is adapted to fit between a frame of an opening in which the window, door or slider is installed and a jamb of the window, door or slider, and the sealing flange is adapted to wrap around an exterior edge of the frame and to be fixed to an exterior surface of the frame. The gasket may comprise a weather tight foam strip having an inward facing surface on which an adhesive is provided. The capsule is preferably capable of compressing under the pressure exerted by a shim without degrading the moisture and air resistance of the capsule.

The preferred method of the invention for installing a moisture and air resistant wrap for windows, doors or sliders, into an opening comprising an interior perimeter, having a length, and an exterior surface, comprises the steps of: providing a length of wrap comprising a moisture and air resistant capsule which substantially encapsulates insulating materials therein; a sealing flange, flexibly joined with the means for encapsulating; and a moisture resistant gasket fixed to the flange; cutting one or more pieces of the wrap so that, together, the cut pieces total a length at least as long as the length of the interior perimeter; fixing the cut pieces of the wrap to the exterior surface, proximate the interior perimeter, along the gasket of the cut pieces; pressing the capsule of the cut pieces into the opening so that the capsule of the cut pieces lies against the inner perimeter. The ends of the cut pieces preferably overlap to some extend. The gasket may be fixed to the exterior surface by any suitable means including pressing a pressure sensitive adhesive provided on an inward facing surface of the gasket against the exterior surface and/or stapling the gasket in place against the exterior surface.

Another preferred method of the invention for installing a moisture and air resistant wrap for windows, doors or sliders, into an opening comprising a sill, a header, two or more jack studs and an exterior surface, comprising the steps of: providing a length of said wrap comprising a moisture and air resistant capsule which substantially encapsulates insulating materials therein; a sealing flange, flexibly joined with the means for encapsulating; and a moisture resistant gasket fixed to the flange, wherein the wrap has a first and second opposing vertical edge; cutting a first piece of the wrap longer than the sill of said window, door or slider opening, respectively, and cutting a slit between the capsule and said sealing flange inward from each of the vertical edges; cutting a second piece to match the first piece; cutting a third and fourth piece, longer than the jack stud and each having two ends, and slitting back the capsule at the ends to expose a portion of the insulating material, and trimming off the exposed insulating material of each end; fixing the sealing flange of the first piece to the exterior surface along the gasket proximate the sill; fixing the sealing flange of the third piece to the exterior surface along the gasket proximate a first of the jack studs; fixing the sealing flange of the fourth piece to the exterior surface along the gasket proximate a second of the jack studs; fixing the sealing flange of the second piece to the exterior surface along the gasket proximate the header; pressing the capsule of the first, second, third and fourth pieces into the opening so that the capsule of the first piece along the sill, the second piece lies along the header and the third and fourth pieces lie along the first and second jack studs, respectively.

This invention is the result of efforts to design a wrap for windows, doors and sliders which is moisture and air tight, installed more quickly and easily than known products and methods, and which facilitates consistent, high quality workmanship. The invention may be adapted for use with all types of doors, windows and sliders.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

The moisture and air resistant wrap of the invention for windows, doors and sliders, generally comprises: an insulating material; a moisture and air resistant capsule which substantially encapsulates the insulating material therein; a sealing flange, flexibly joined with the means for encapsulating; and a moisture resistant gasket fixed to the flange. The capsule is adapted to fit between a frame of an opening in which the window, door or slider is installed and a jamb of the window, door or slider. The sealing flange is adapted to wrap around an exterior edge of the frame and be fixed along the gasket to an exterior surface such as the exterior wall of a building. The gasket is a weather tight foam strip which may have an inward facing surface on which a pressure sensitive adhesive is provided.

Figure 1A:
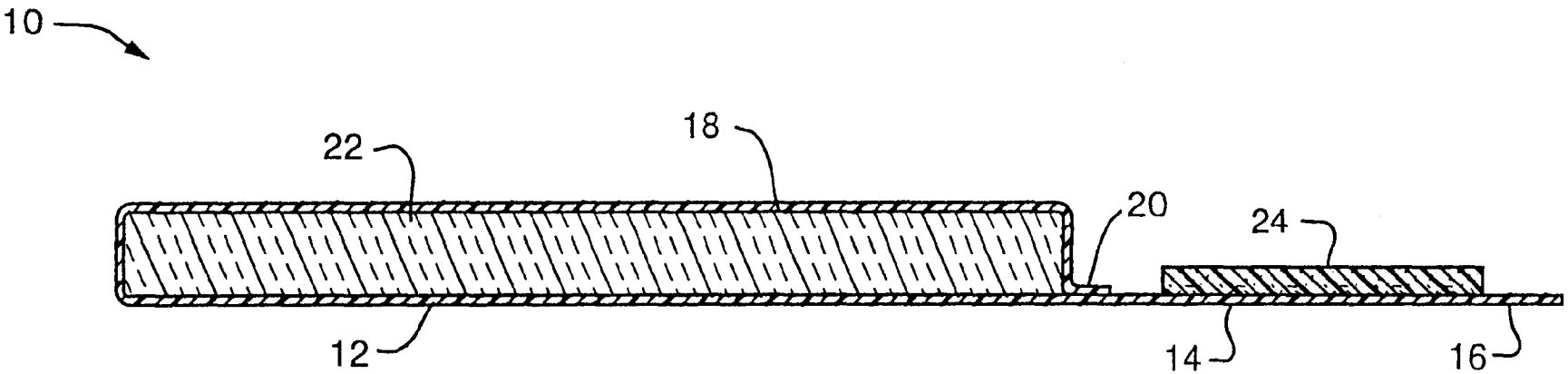
FIG. 1A is a cross-sectional view of a preferred embodiment of the moisture and air tight wrap of the invention for windows, doors and sliders.
Figure 1B:
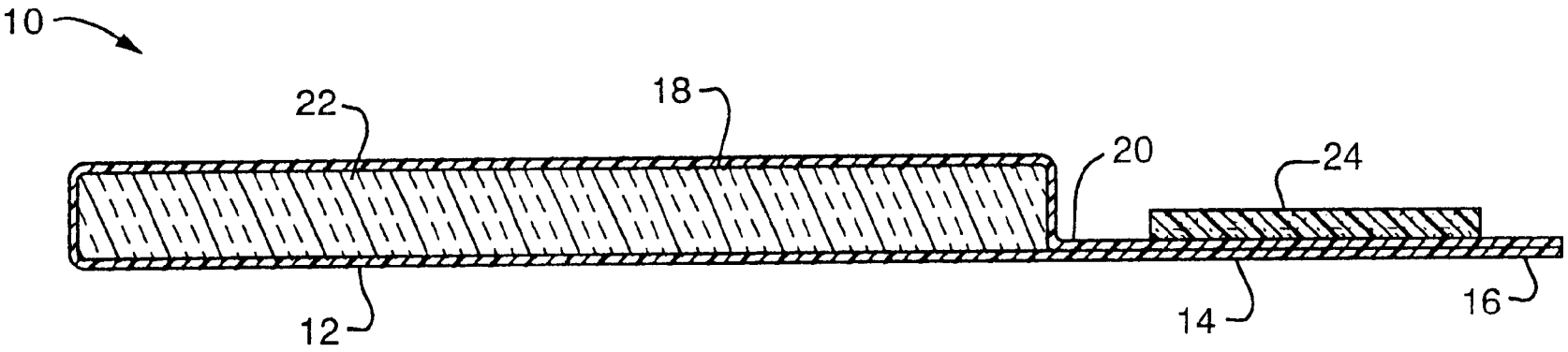
FIG. 1B is a cross-sectional view of the preferred embodiment shown in FIG. 1A in which the sealing edge extends to edge of the flange portion.
Figure 1C:
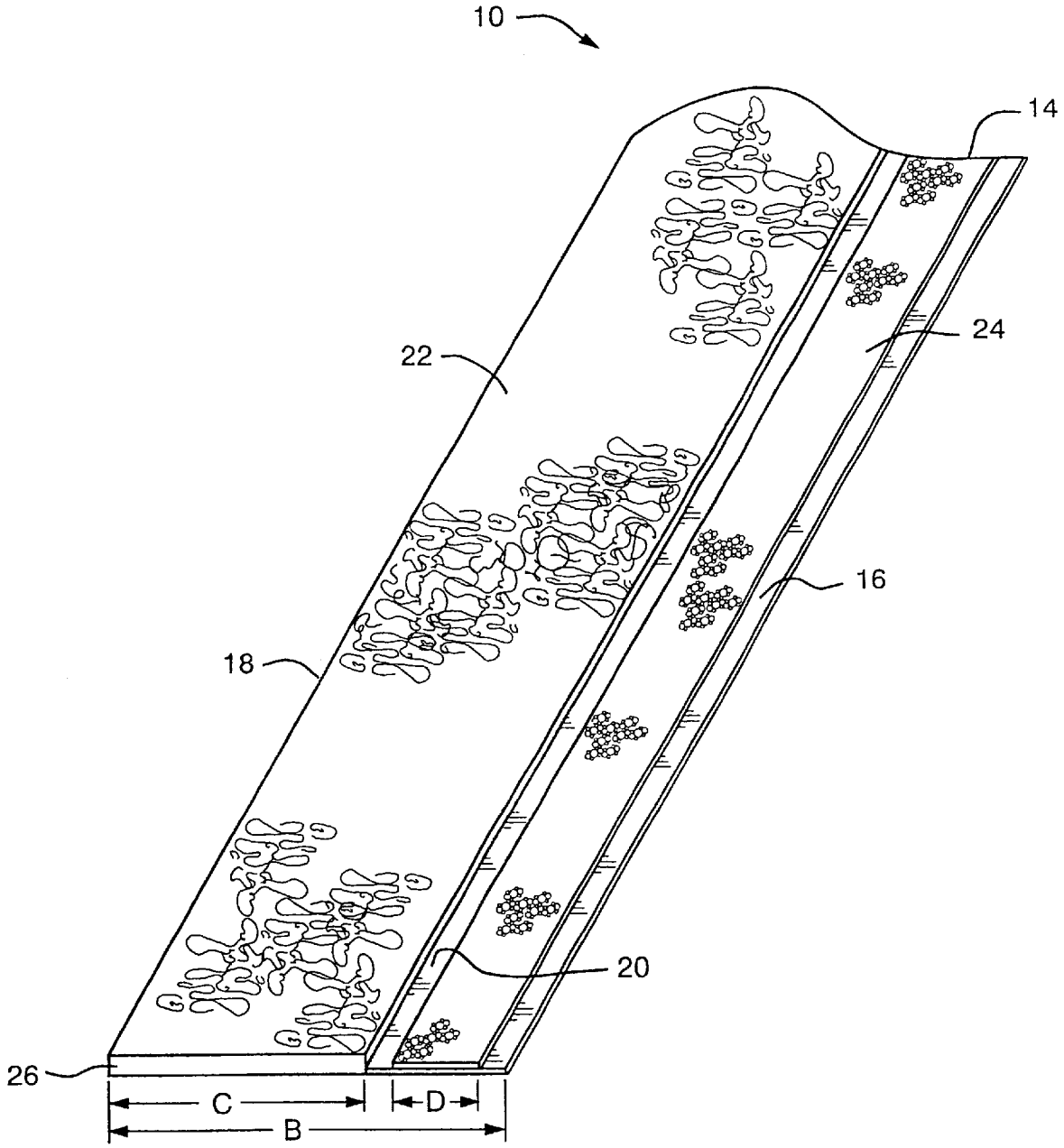
FIG. 1C is a perspective view of the wrap shown in FIG. 1A or 1B.

FIGS. 1A and 1C illustrate a preferred embodiment of the wrap, generally referred to as wrap 10, of the invention for windows, doors and sliders. Wrap 10 is constructed of sheet 12, a portion of which forms flange 14, including extension 16, and capsule 18, including sealing edge 20. Capsule 18 is formed by wrapping a portion of sheet 12 over on itself around insulation material 22 and heat sealed to the base portion of sheet 12 along sealing edge 20. Sealing edge 20 could be extended out across the top of flange 14 to the edge of extension 16 before fixing gasket 24 to flange 14 over sealing edge 20 as shown in FIG. 1B. A gasket 24 is adhesively fixed to the flange 14. The width of capsule 18 is shown by arrow C and preferably corresponds to the width of the wall framing. For example, the jamb of a window is generally either 4⁹⁄₁₆ or 6⁹⁄₁₆ inches wide. The width of gasket 24, represented by arrow D, is preferably about 1¼ to 2 inches and should be positioned so that extension 16 is at least about ½ inch wide. The width of gasket 24 will depend upon the manufacturer's choice. The space between gasket 24 and capsule 18 should be about ½ inch as well. Arrow B represents the overall width of wrap 10 and will depend on the width of the framing and desired width of flange 14. Assuming two typical jambs having a width of 4⁹⁄₁₆ and 6⁹⁄₁₆ inches, respectively, the overall preferred width of wrap for these two casings would be 7 and 9 inches, respectively. The width of wrap 10 could be wider depending on the application. For example, a wider extension 16 may be desired to allow for a wider exterior trim.

Sheet 12 is preferably a vinyl vapor barrier having a thickness of 3–6 mill, preferably 4 mill or less. The width of sheet 12 will again vary depending on the width of the casing and the depth of the wall stud. However, using the examples above for a 7 and 9 inch casing, respectively, the width of sheet 12 is preferably about 14 and 18 inches wide, respectively. The vinyl vapor barrier is available from Carlisle Plastic, Minneapolis Minn. 35431 (Tyco International) and Sunbelt Manufacturing Co., Monroe La. 71211. Although the material used for sheet 12 could feasibly vary, the material should be moisture resistant and should not be so thin that it tears during installation. Moreover, if the alternate material is too thick, it will cause the wrap to be too stiff to install.

Insulation material 22 is preferably fiberglass insulation having a thickness of about ½ inch, the width of which again will depend on the casing and wall stud depth. Using the 7 and 9 inch casing examples, the width of the fiberglass insulation is preferably about 4 and 6 inches, respectively.

The thickness of the insulation material could be thicker or thinner depending on the depth of insulation desired between the casing and the wall stud. Insulation material 22 is commercially available as a fiberglass blanket roll and is available from Owens Corning, Certain Teed, and Knuff Corporation. The thickness is generally between ½ to 1 inch thick. Other suitable insulation materials may be used including but not limited to soft foam such an ether foam (open or closed cell) which is a type of polyvinyl chloride.

Gasket 24 is preferably a self-adhering PVC foam gasket commercially known as weather-stripping and is commercially available from Frost King, Therwell Products, Patterson, N.J. 07524 and from Macklenberg-Duncan, Oklahoma City, Okla. 73118. The thickness of the gasket will vary depending on the application but generally is between ⅛–3/16 inches thick. Gasket 24 may be fixed to sheet 12 using any suitable means including an adhesive. The foam gasket is commercially available with or without a single- or double-sided pressure sensitive adhesive. Other possible materials for gasket 24 include but are not limited to a thin rubber, soft plastic or multiple beads of silicon caulk or sealer, keeping in mind that gasket 24 should create a weather-tight seal between the wrap and the exterior surface to which the wrap is fixed.

Wrap 10 is assembled by rolling out vinyl sheet 12 so that it lays flat and placing the fiberglass material length wise down sheet 12 almost entirely on one side of sheet 12 overlapping the center line of sheet 12 by about 1 inch. Vinyl sheet 12 is then folded in half lengthwise, keeping the fiberglass near the center line without allowing the fiberglass to bunch up or roll back on itself. Then the vinyl is heat sealed along all or a portion of sealing edge 20 at or near the center line of sheet 12 to form capsule 18. As noted above, sealing edge 20 may extend out across the top of flange 14 to the edge of extension 16, in which case gasket 24 in preferably fixed to flange 14 so that sealing edge 20 is sandwiched in between gasket 24 and the bottom of sheet 12. Although ends 26 could be sealed as well, they are generally left open to trim back any excess insulation on site when necessary. Gasket 24 is then placed on flange 14 about ½ inch from capsule 18 and about ½" from the unsealed edge of sheet 12 to form extension 16. Wrap 10 may be assembled in any length suitable for shipping and use.

Figure 2:
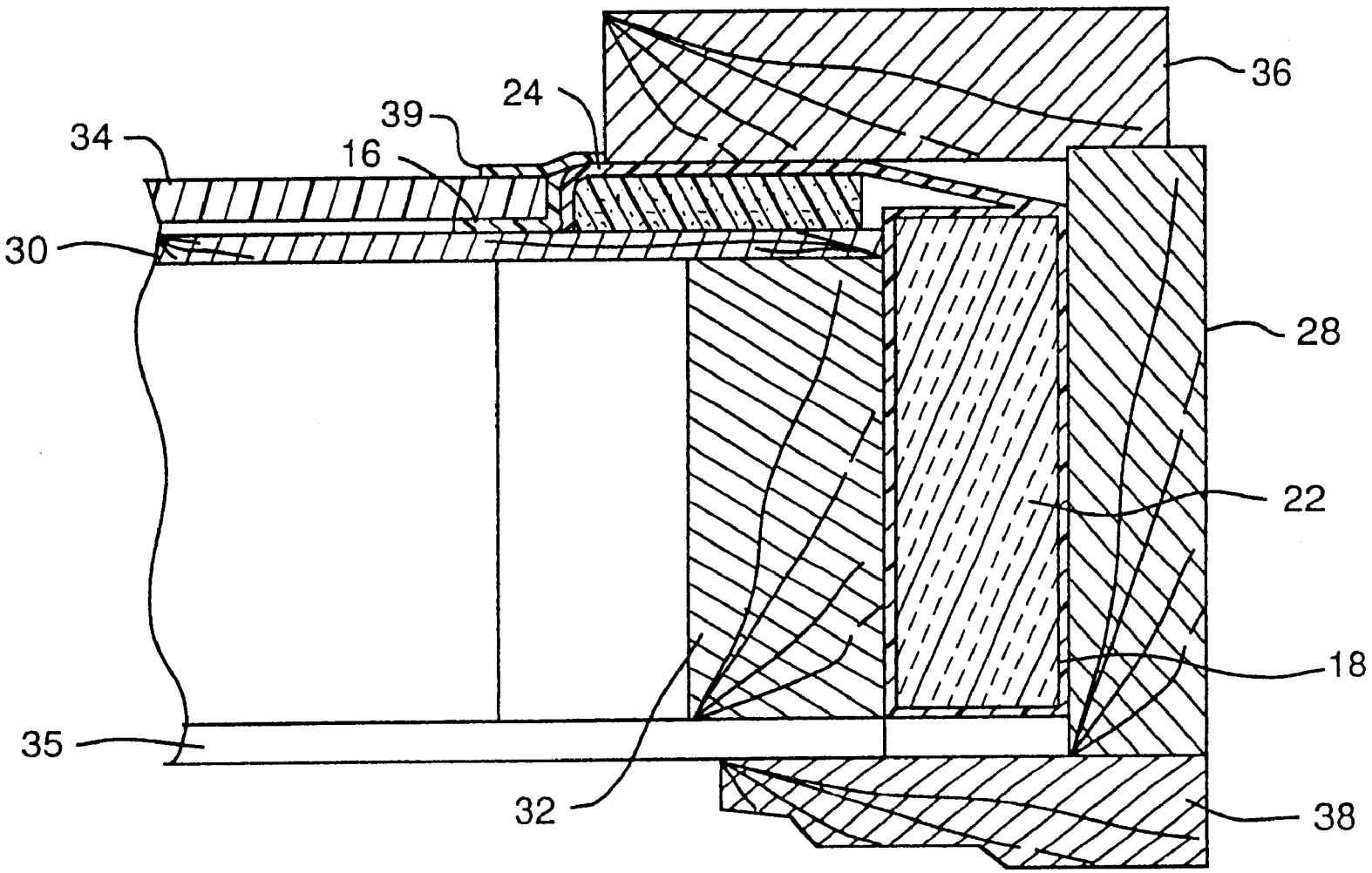
FIG. 2 is a cross-sectional view of the wrap shown in FIG. 1C installed in a partial window opening using the method of the invention for installing the wrap of the invention.

FIG. 2 shows wrap 10 in cross-section installed in a partial opening of a window. Capsule 18 encapsulating insulating material 22 is sandwiched between wall stud 32 and window casing 28. Flange 14 is bent around the exterior edge of the window opening and gasket 24 is sandwiched between exterior wall 30 and exterior trim 36. Extension 16 is sandwiched between exterior wall 30 and house wrap 34. House wrap 34 overlaps the outer edge of extension 16. A sealing tape 39 is shown applied over both house wrap 34 and extension 16 to further seal the area from moisture and air. Gasket 24 is fixed to wall 30 using staples or any other suitable means for fixing. Capsule 18 is not fixed to the studs, frame or jambs. It floats free to allow for window adjustment. Both the interior trim 38 and the exterior trim 36 may be fixed to the interior and exterior surfaces by methods known in the art including nailing through the trim to the interior sheetrock 35 or exterior wall 30, respectively; nailing through the casing trim through gasket 24 into wall 30; or, in the case of the exterior nail fin, through the fin, wrap 10, gasket 24 and into wall 30.

Figure 3:
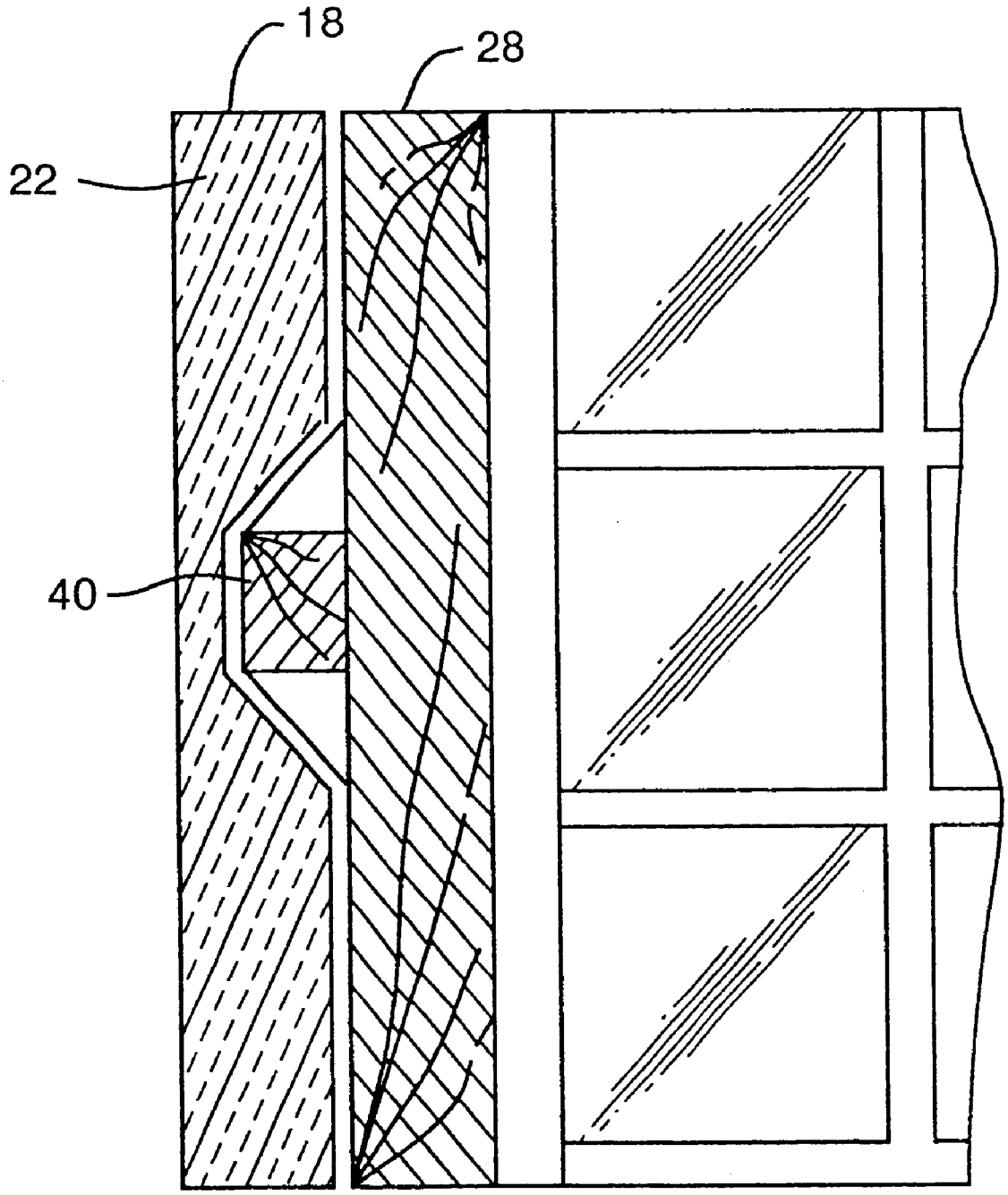
FIG. 3 is a cross-sectional view of the wrap shown in FIG. 1C installed in a side view of a partial window opening utilizing a shim, using the method of the invention for installing the wrap of the invention.

FIG. 3 is a side view of wrap 10 installed in a partial window opening, further including shim 40. Unlike previous materials and methods used, there is no need to cut out portions of wrap 10 to accommodate shims such as shim 40. Capsule 18, and likewise insulation material 22, is adapted to compress under the pressure exerted by shim 40 and casing 28.

Figure 4:
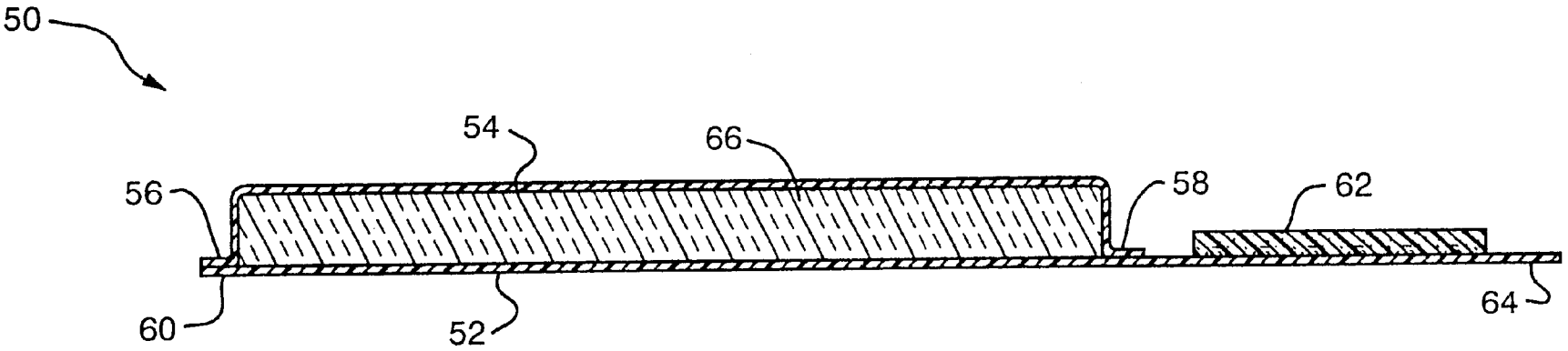
FIG. 4 is another preferred embodiment of the moisture and air tight wrap of the invention for windows, doors and sliders.

FIG. 4 is another preferred embodiment of the wrap of the invention, generally referred to as wrap 50. Wrap 50 differs from wrap 10 only in that it is assembled from two separate vinyl sheets 52 and 54. Wrap 50 is assembled by laying sheet 52 out flat and placing insulation material 66 lengthwise on sheet 52 almost entirely on one side of sheet 52 overlapping the center line of sheet 52 by about 1 inch. Sheet 54 is then placed on top of and around the sides of insulation material 66 and heat sealed to sheet 52 along sealing edges 56 and 58. During assembly, as described above in reference to wrap 10, insulation material 66 should not be allowed to bunch or roll up or move away from the center line of sheet 52. Extension 60 is left trailing less than ½ inch from sheet 52. Gasket 62 is then laid out on and fixed to sheet 52 leaving extension 64. The preferred dimensions of wrap 50 are the same as wrap 10.

Figure 5:
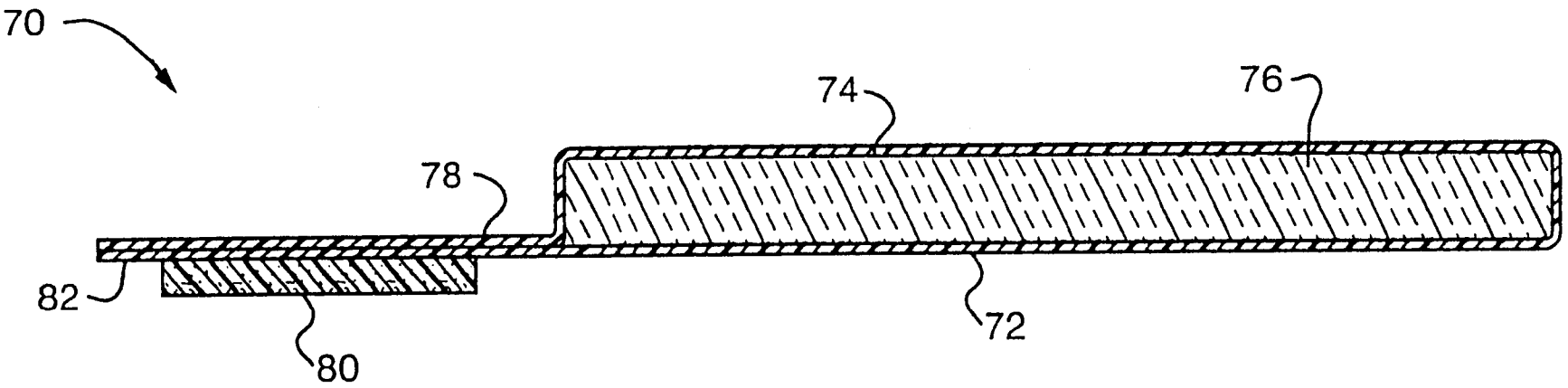
FIG. 5 is yet another preferred embodiment of the moisture and air tight wrap of the invention for windows, doors and sliders.
Figure 6:
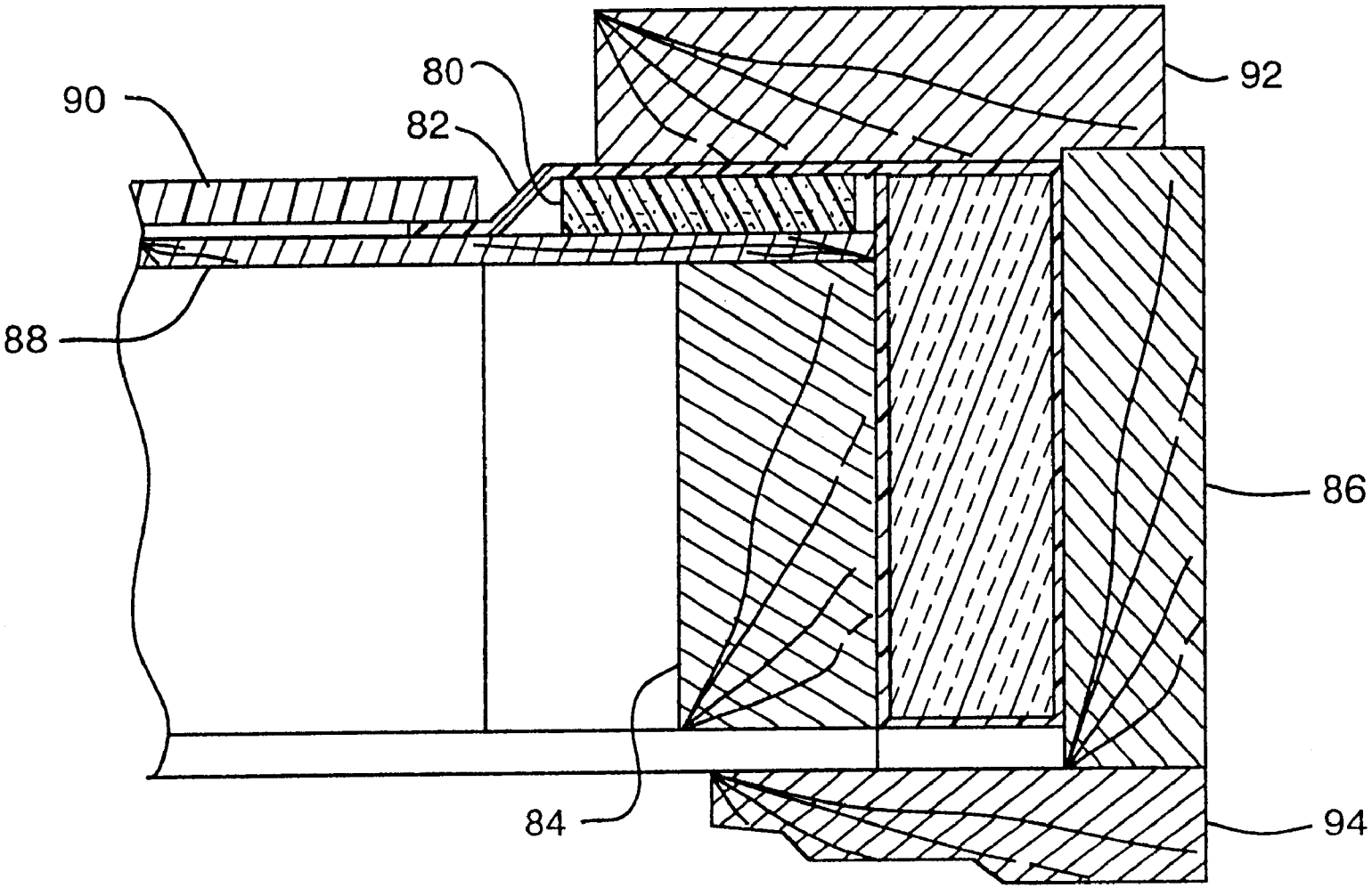
FIG. 6 is a cross-sectional view of the wrap shown in FIG. 5 installed in a partial window opening using the method of the invention for installing the wrap of the invention.

FIG. 5 is yet another preferred embodiment of the wrap of the invention, generally referred to as wrap 70. Wrap 70 is similar to wrap 10 except that gasket 80 is fixed to the side of sheet 72 opposite from capsule 74 and sealing edge 78. Gasket 80 should have a pressure sensitive adhesive on both sides. Wrap 70 is similarly made up of insulation material 76 encapsulated by capsule 74 formed by folding sheet 72 over on itself and sealing leading edge 78 to sheet 72. Gasket 80 is fixed to a flange of sheet 72 leaving a space between gasket 80 and capsule 74 and the trailing edge of sheet 72 to form extension 82. FIG. 6 shows wrap 70 installed in a partial window opening. Wrap 70 is installed in much the same way as wrap 10 except that gasket 80 is fixed to exterior wall 88 by simply pressing the inward surface (on which the pressure sensitive adhesive is located) of gasket 80 to exterior wall 88. Once in place, capsule 74 is sandwiched between jamb 86 and wall stud 84. Gasket 80 is sandwiched between exterior trim 92 and wall stud 84 and extension 82 is sandwiched between house wrap 90 and exterior wall 88. Exterior trim 92 and interior trim 94 may be applied in using any conventional means. Although not shown, sealing tape 39 should be applied to overlap both house wrap 90 and extension 82.

Figure 7:
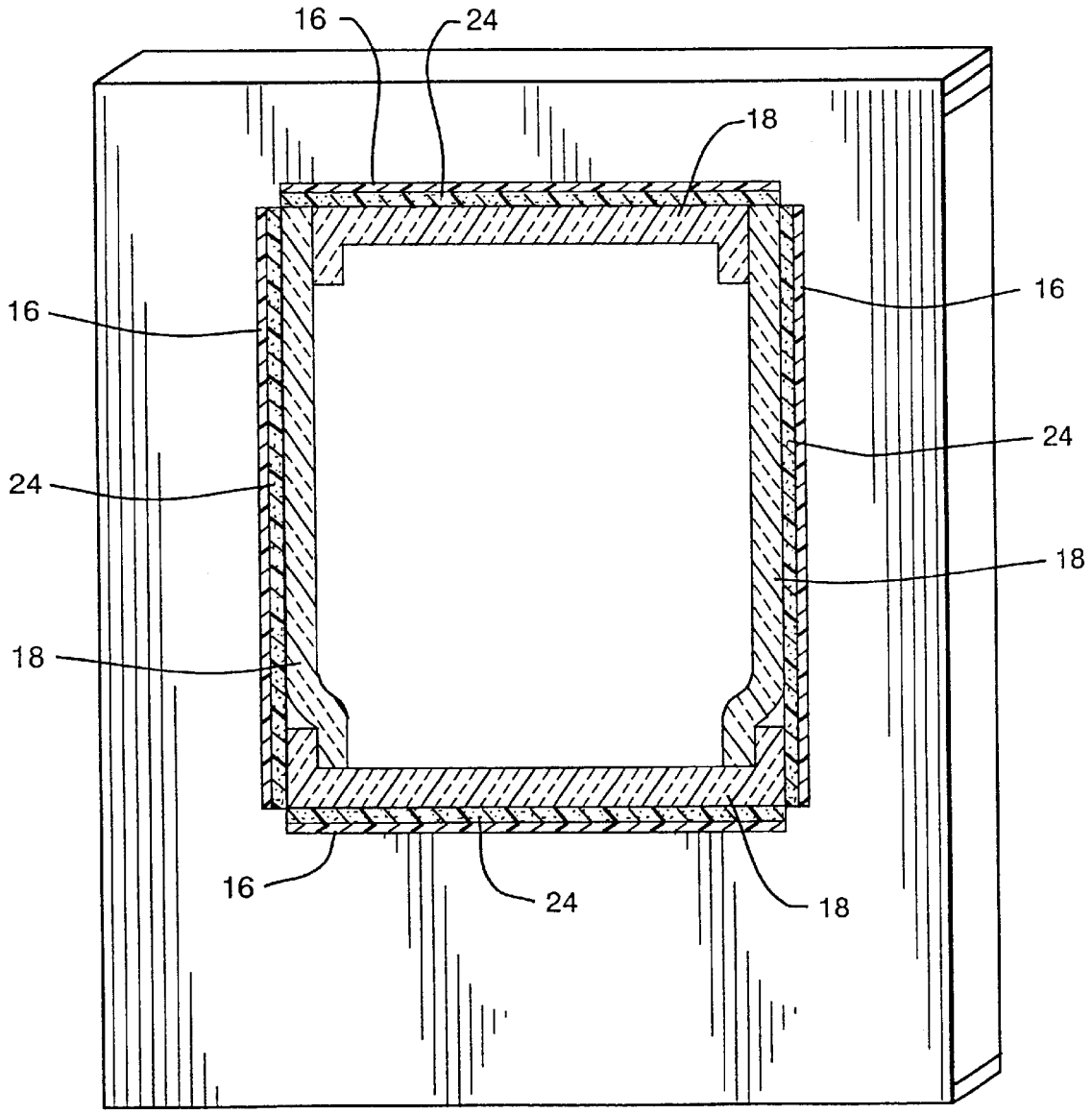
FIG. 7 is a outside view of the wrap shown in FIG. 1B installed in a window opening.

Wrap 10 of the invention is shown in FIG. 7 pressed into a window opening, using the method of the invention, prior to installing the window. To use the wrap of the invention, a first length of the wrap is cut about 4 inches longer than sill 96 of the opening. The ends of this first piece are slit about 2 inches in from each end between gasket 24 and capsule 18. A second length for the header is cut to match the first length or sill piece. A third and fourth piece are cut about 2 inches longer than the jack stud. The ends of the third and fourth lengths are slit back about 1 inch and about 1 inch of the fiberglass is trim off of the ends, leaving gasket 24 long. The first length is stapled in place to exterior wall 30 along gasket 24 so that sealing edge 20 lines up with or bends around the exterior edge of the sill. The third and fourth lengths are then stapled in place to exterior wall 30 along gasket 24 so that sealing edge 20 lines up with the edge of exterior wall 30 where wall 30 meets the exterior edge of wall stud 32. The second length is similarly stapled in place to exterior wall 30 along gasket 24 so that sealing edge 20 lines up with the exterior edge of the header. When the lengths are stapled in position, capsule 18 of each piece is pushed into the opening so that it flexes freely. The ends of the first length or sill piece should lap up the sides of the wall studs about 2 inches behind the third and fourth lengths. The second length laps down the sides of the wall studs over the third and fourth lengths.

Figure 8A:
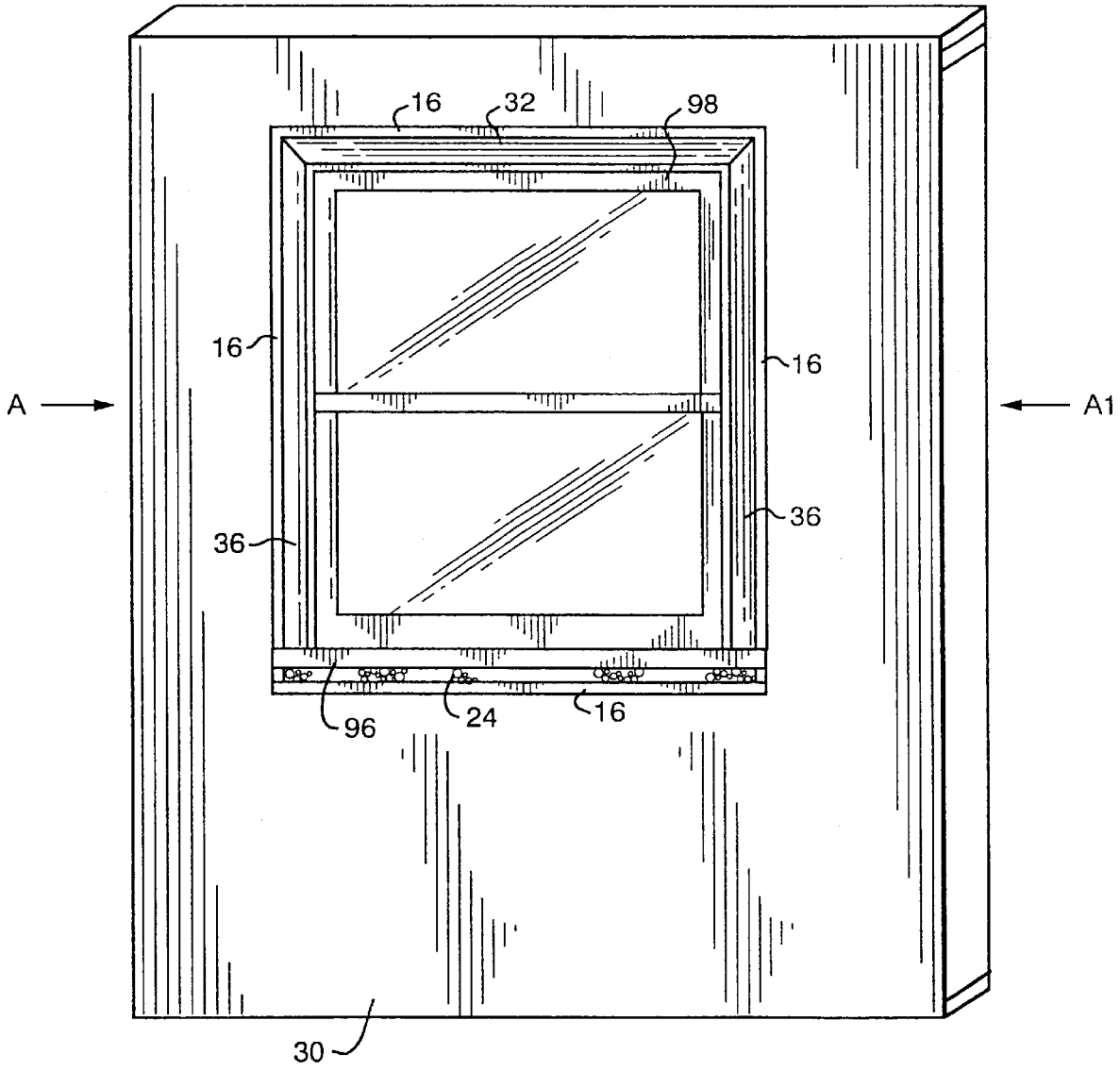
FIG. 8A is an outside view of the wrap as shown in FIG. 7 in which a complete window, including the sash, is seated in the opening overlying the wrap.
Figure 8B:
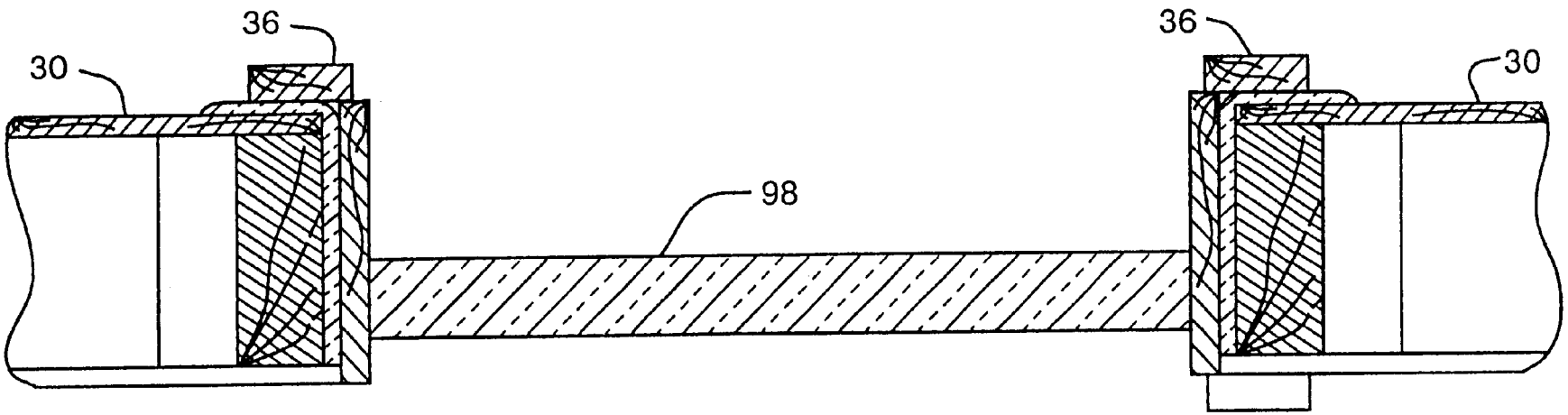
FIG. 8B is a cross-sectional view of the wrap and window completely installed as shown in FIG. 8A along line A—A.

FIGS. 8A and 8B show wrap 10 in the window opening of FIG. 7 after window 98 has been installed. To install window 98, set two wood shingles or other suitable items on the sill piece to protect wrap 10 from tearing. Then set the bottom of the window on the shingles and push into place. Plumb and square window 98 and then nail through window trim 36 and gasket 24. Install the head flashing and nail into place. House wrap 34 (not shown in FIG. 8A or 8B) is then pulled tightly across window 98, stapled in place and cut out around the window. Sealing tape 39 (not shown in FIG. 8A or 8B) is then applied to overlap house wrap 34 and underlying extension 16.

If using wrap 70 with the double-sided adhesive, gasket 80 may be fixed to the exterior wall simply by exposing the pressure sensitive adhesive provided on the inward facing surface of gasket 80 and pressing gasket 80 directly to the exterior wall. Otherwise both wrap 70 and/or wrap 50 may be installed in the same manner as wrap 10.

The method of the invention is not limited for use in openings having a square or rectangular shape. For example, fewer or more pieces may be desired depending on the shape of the opening. The essential steps of the method of the invention comprise sizing, and if necessary, cutting, the wrap to fit the internal dimensions of the opening; fixing the gasket to the exterior wall; and pressing the insulating capsule into the opening.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A moisture and air tight wrap for windows, doors and sliders, having improved installation and sealing characteristics, comprising:

a moisture and air tight barrier comprising a capsule portion and a flange portion;

insulating material substantially encapsulated in said capsule portion; and a moisture resistant gasket fixed to said flange portion.

2. The wrap of claim 1, wherein said barrier comprises a sheet of plastic of which at least a portion is folded over on itself and sealed in place, thereby forming said capsule.

3. The wrap of claim 1, wherein said barrier comprises two sheets of plastic, having one or more corresponding edges, sealed together along one or more of said edges, thereby forming said capsule.

4. The wrap of claim 1, wherein said capsule is adapted to sit between a jamb of said window, door or slider and an opening in which said window, door or slider, respectively, is installed.

5. The wrap of claim 1, wherein said gasket is adapted to sit between an exterior trim of said window or door and an exterior wall of an opening in which said window or door, respectively, is installed.

6. The wrap of claim 1, wherein said capsule is adapted to compress under a pressure exerted by shims without degrading the moisture or air tightness of said wrap.

7. A moisture and air resistant wrap for windows, doors and sliders, comprising:

an insulating material;

a moisture and air resistant capsule which substantially encapsulates said insulating material therein;

a sealing flange, flexibly joined with said capsule; and a moisture resistant gasket fixed to said flange.

8. The wrap of claim 7, wherein said capsule is adapted to fit between a frame of an opening in which said window, door or slider is installed and a jamb of said window, door or slider.

9. The wrap of claim 8, wherein said sealing flange is adapted to wrap around an exterior edge of said frame and to be fixed to an exterior surface of said frame.

10. The wrap of claim 9, wherein said gasket comprises a foam strip having an inward facing surface on which an adhesive is provided.

11. The wrap of claim 8, wherein said capsule is capable of compressing under pressure exerted by a shim without degrading said moisture and air resistance of said capsule.

12. A method for installing a moisture and air resistant wrap for windows, doors or sliders, into an opening comprising an interior perimeter, having a length, and an exterior surface, comprising the steps of:

providing a length of wrap comprising a moisture and air resistant capsule which substantially encapsulates insulating materials therein; a sealing flange, flexibly joined with said means for encapsulating; and a moisture resistant gasket fixed to said flange;

cutting one or more pieces of said wrap so that, together, said cut pieces total a length at least as long as said length of said interior perimeter;

fixing said cut pieces of said wrap to said exterior surface, proximate said interior perimeter, along said gasket of said cut pieces;

pressing said capsule of said cut pieces into said opening so that said capsule of said cut pieces lies against said inner perimeter.

13. A method for installing a moisture and air resistant wrap for windows, doors or sliders, into an opening comprising a sill, a header, two or more jack studs and an exterior surface, comprising the steps of:

providing a length of said wrap comprising a moisture and air resistant capsule which substantially encapsulates insulating materials therein; a sealing flange, flexibly joined with said means for encapsulating; and a moisture resistant gasket fixed to said flange, wherein said wrap has a first and second opposing vertical edge;

cutting a first piece of said wrap longer than the sill of said window, door or slider opening, respectively, and cutting a slit between said capsule and said sealing flange inward from each of said vertical edges;

cutting a second piece to match said first piece;

cutting a third and fourth piece, longer than said jack stud and each having two ends, and slitting back said capsule at said ends to expose a portion of said insulating material, and trimming off said exposed insulating material of each end;

fixing said sealing flange of said first piece to said exterior surface along said gasket proximate said sill;

fixing said sealing flange of said third piece to said exterior surface along said gasket proximate a first of said jack studs;

fixing said sealing flange of said fourth piece to said exterior surface along said gasket proximate a second of said jack studs;

fixing said sealing flange of said second piece to said exterior surface along said gasket proximate said header;

pressing said capsule of said first, second, third and fourth pieces into said opening so that said capsule of said first piece along said sill, said second piece lies along said header and said third and fourth pieces lie along said first and second jack studs, respectively.

* * * * *